US005895169A

United States Patent [19]

Holm et al.

[11] Patent Number: 5,895,169

[45] Date of Patent: Apr. 20, 1999

[54] COLLAPSIBLE AND REMOVABLE BARRICADE POST ASSEMBLY

[75] Inventors: Carl D. Holm, Mission; Kyle Anderson, Langley, both of Canada

[73] Assignee: Carl David Holm, Mission, Canada

[21] Appl. No.: 08/783,694

[22] Filed: Jan. 14, 1997

Related U.S. Application Data

[XX .

[60] Provisional application No. 60/029,899, Nov. 8, 1996.

[51] Int. Cl.[6] ..... E01F 9/019; E01F 9/013

[52] U.S. Cl. ..... 404/9; 49/35; 49/49; 248/156

[58] Field of Search ..... 404/6, 9, 10; 49/35, 49/49, 131; 248/156

[56] References Cited

U.S. PATENT DOCUMENTS

| | | | |
|---|---|---|---|
| 3,061,960 | 11/1962 | Dull | 49/35 |
| 3,417,508 | 12/1968 | Sprung | 49/131 |
| 3,688,439 | 9/1972 | Doxsee | 49/49 |
| 3,925,929 | 12/1975 | Montgomery | 49/35 |
| 3,956,853 | 5/1976 | Montgomery | 404/10 |
| 4,240,766 | 12/1980 | Smith et al. | 404/10 |
| 4,926,592 | 5/1990 | Nehls | 40/607 X |
| 5,299,883 | 4/1994 | Arth, Jr. | 404/10 |
| 5,441,359 | 8/1995 | Filippi | 49/35 X |

FOREIGN PATENT DOCUMENTS

| | | | |
|---|---|---|---|
| 1401359 | 4/1965 | France | 49/35 |

*Primary Examiner*—James A. Lisehora
*Attorney, Agent, or Firm*—Hughes, Multer & Schacht, P.S.

[57] ABSTRACT

A removable and collapsible barricade post assembly for the restriction of vehicular traffic. The barricade post assembly has a novel base assembly that allow the post assembly to be removed from its mounting bracket which is normally permanently affixed to the ground. Alternatively, the post assembly can remain attached to its mounting bracket while being lowered to allow the passage of vehicular traffic. The barricade post assembly has a number of security features to restrict the unauthorized removal or collapsing of the barricade post. A cover assembly to enhance security and to provide weather protection for the barricade post assembly is also described.

36 Claims, 5 Drawing Sheets

COLLAPSIBLE AND REMOVABLE BARRICADE POST ASSEMBLY

This application claims the benefit of U.S. Provisional Application No. 60/029899, filed Nov. 8, 1996.

BACKGROUND OF THE INVENTION

1. Field of the Invention

This invention relates generally to the field of barricade post assemblies and particularly to a barricade post assembly that obstructs passage in an upright position, can be lowered to a non-obstructing collapsed position, or that can be removed and replaced at will. An optional cover assembly provides weather protection and added security.

2. Background Art

Barricade posts of the type discussed herein are commonly used for control of vehicular traffic. The operation of the typical barricade post is fairly simple. When placed in its operating position, the barricade post assembly blocks traffic. When removed or collapsed, the barricade post assembly allows the free movement of traffic. A number of patents, discussed below, have attempted to make the transition from the blocking position to the unblocking position as convenient as possible. The instant invention improves on the prior designs by combining versatility, economy, utility and convenience.

When deployed, the barricade post is used either to keep vehicular traffic in or keep it out. An example of using a barricade post for keeping vehicular traffic in is using it across the driveway of an automobile dealership. During the day, the barricade post is removed or collapsed to permit the free passage of automobiles on and off the lot. The barricade posts are returned to their barricading position after closing, thereby keeping the vehicles in and impeding their theft. The barricade post can also be used to protect a single automobile from theft. For instance, a car parked in a parking space with a wall in front of it could be secured by positioning a barricade post relatively close to the rear bumper of the car. Unless the barricade post is removed or collapsed, the car is constrained between the barricade post and the wall. A second barricade post also could be placed in front of the car if there is nothing else available to impede the forward movement of the car.

The second major use of barricade posts is to keep vehicular traffic out of a particular location. For instance, a barricade post can keep unauthorized users out of a reserved parking space. Keeping an automobile out of a residential driveway can discourage theft. As another example, it is often desirable to keep most vehicles out of an area while permitting access for emergency vehicles. A pedestrian mall in a downtown shopping area is an example of this. Sometimes a barricade post is useful for simply directing traffic. For instance, in a parking lot during a football game, a barricade post could force most the traffic to one side of the parking lot, while permitting the spaces nearest the stadium to be used only by season ticket holders.

A third major use for barricade posts is to protect an object against the damage that a vehicle can cause to it. For instance, oil and gas meters are frequently protected by sinking steel pipe barricades into concrete at various points around the meter. This is effective for protecting the meter, but access to the meter for repair is limited by the barricade's permanent installation.

The utility of barricade posts for the control of traffic, for the protection of objects, and for security, has long been recognized and many designs have been proposed. For instance, in 1933, a telescoping traffic guard was taught in U.S. Pat. No. 1,916,787 (Elston). The traffic guard discussed in Elston is comprised of a barricade post and a sleeve assembly. The whole assembly is buried in the ground. When the barricade post is needed, it is pulled from the sleeve and it automatically latches when it reaches its upright position. Variations on this telescopic configuration are found in U.S. Pat. No. 5,192,159 (Higginson) and U.S. Pat. No. 5,365,694 (Macaluso). Both of these patents have barricade posts contained in sleeves that are buried. To deploy the barricade posts, they are pulled up into position. Higginson secures the barricade post in position by using a handle to move a cross bar that is attached to the post into engagement with the sleeve. Macaluso teaches a tongue that flops out when the barricade post is extended. A padlock attached to the tongue keeps the post from returning to its sleeve.

The second type of barricade post found in the background art involves a collapsible barricade post. These patents teach a bracket connected to the ground and a barricade post connected to the bracket by a pivot pin. In an upright position, the barricade post assembly blocks traffic. When the barricade post is collapsed about the pivot pin, it is possible for traffic to pass over the barricade. The barricade posts taught in these patents, however, can not be removed but only collapsed—the brackets are mounted permanently to the ground. Examples of these patents include U.S. Pat. No. 3,061,960 (Dull), U.S. Pat. No. 3,417,508 (Sprung), U.S. Pat. No. 3,688,439 (Doxsee), U.S. Pat. No. 4,762,439 (Carlyle), and U.S. Pat. No. 5,018,902 (Miller et al.).

A third type of barricade post is taught in U.S. Pat. No. 4,062,149 (Collins) and U.S. Pat. No. 5,509,754 (Conigliaro). These patents teach a sleeve and barricade post combination. The sleeve is permanently secured in a base location and the barricade post is inserted into the sleeve. The barricade post can be removed from the sleeve when not in use and placed in storage. The barricade posts taught in these patents do not collapse into a non-obstructing position—they must be completely removed.

SUMMARY OF THE INVENTION

Despite at least a half century of trying, the designs discussed above still have shortcomings. The telescoping and collapsible barricades are all permanent installations. A separate barricade post assembly is required for each and every location where a barricade might potentially be beneficial. The cost of purchasing and installing a barricade in every location where one may prove useful has proven to be prohibitive for many applications. Repair of these devices is made difficult by the permanent nature of their mounting. Also, while the barricades can be collapsed for traffic, or for access to a protected object, they still present a significant obstruction. For instance, a user may desire to have a post barricade in his or her driveway for security purposes at night. If that same user wishes to play basketball in the driveway during the day, the danger of tripping over the collapsed barricade is obvious.

The removable type barricade poles similarly have their problems. For any barricade post to be effective as a security device, it must be made of a material that is able to withstand a reasonable impact from a motor vehicle. This translates into a heavy metal post usually made of steel. For many applications, such as securing a vehicle, controlling traffic flow, and protecting a parking space against unauthorized use, the barricade post need only be lowered temporarily while the vehicle passes over. Removing and replacing the heavy barricade post assembly when it only needs to be lowered temporally, therefore, is unnecessarily difficult.

The present invention addresses the deficiencies of the designs discussed above. The present invention is secure, economical and adaptable for many uses. It can be temporarily collapsed to permit passage, it can be removed when no longer needed, it is easy to remove if it, or the object it protects, is in need of repair, and it can be replaced at will.

DESCRIPTION OF THE PREFERRED EMBODIMENTS

Figure 1:
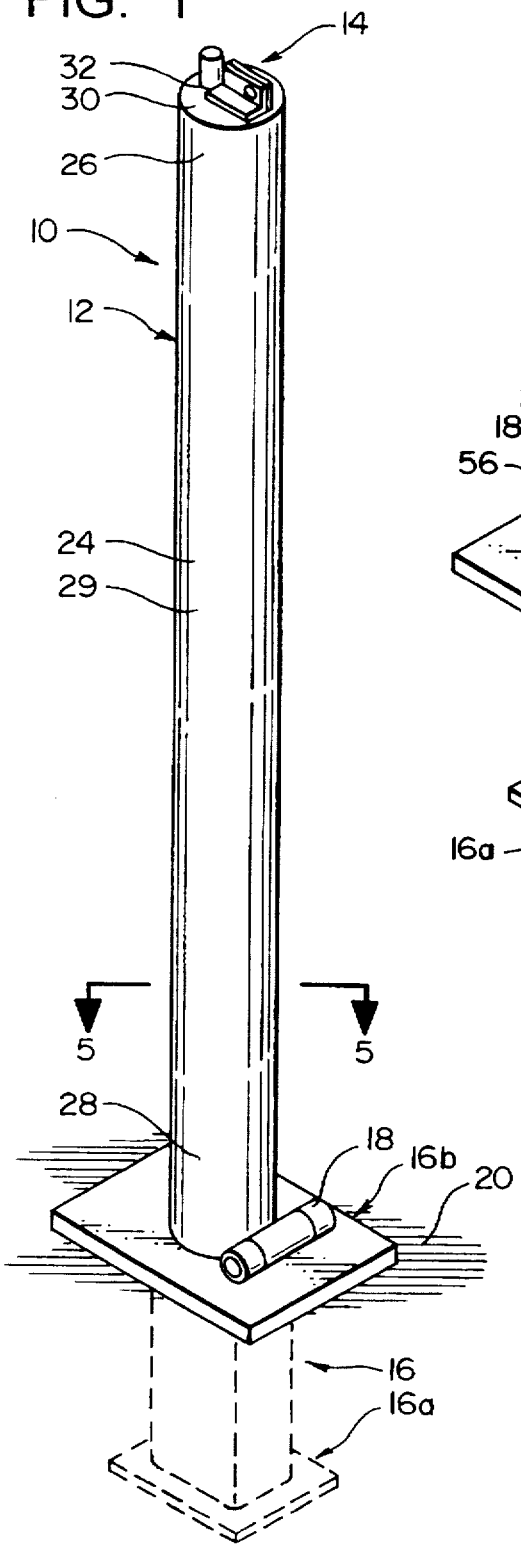
FIG. 1 is a side elevational view showing a preferred embodiment of the barricade post assembly with its permanent base member installed below ground level.

The barricade post assembly 10 comprises a post assembly 12, a security locking means 14, a base assembly 16 (comprising a permanent base member 16*a* and a removable base member 16*b*) and a hinge 18. The permanent base member 16*a* is embedded into a base location 20. Desirably, this is accomplished by digging a hole in the ground somewhat wider and deeper than the permanent base member 16*a*, positioning the permanent base member 16*a* in the hole and pouring concrete around it. However, the base location 20 could be in a location where it would be desirable to use the barricade post assembly 10. Examples of base locations include, paved parking lots, a floor in a multi-level parking garage, a street, around the perimeter of a ship, next to a gasoline pump, in front of a natural gas meter, etc.

The removable base member 16*b* is positioned inside the permanent base member 16*a*, and is retained in there by releasable locking means which will be explained later herein.

The post assembly 12 has a security locking means 14 incorporated therein, and this post assembly 12 is rotatably mounted to the removable base member 16*b* by means of the hinge 18.

The barricade post assembly 10 has three operating positions. First, there is a barricading position, shown in FIG. 1, where the post assembly 12 is in its vertical barricading position, with the security locking means 14 in its locked position. Second, there is the collapsed position, shown in FIG. 2, where the security locking means 14 has been moved to its unlocked position, and the post assembly 12 is rotated ninety degrees to a horizontal position adjacent to the ground surface. The post assembly 12 is generally placed in its collapsed position when it's desired to temporarily move the post assembly 12 from its barricading position to permit passage of a vehicle or the like, and then move the post assembly 12 back to its barricading position. Then there is a third position shown in FIG. 6, where the post assembly 12 and the removable base member 16*b* are totally removed from the permanent base member 16*a* and moved to some other location.

There will now be a more detailed description of the present invention.

The post assembly 12 is comprised of a tubular post section 24 with a top portion 26, a bottom portion 28, an interior 27; and, an exterior 29; a lid 30 fixedly attached, for example by welding, to the top portion 26 of the tubular post section 24; and, a security locking means 14.

Figure 7:
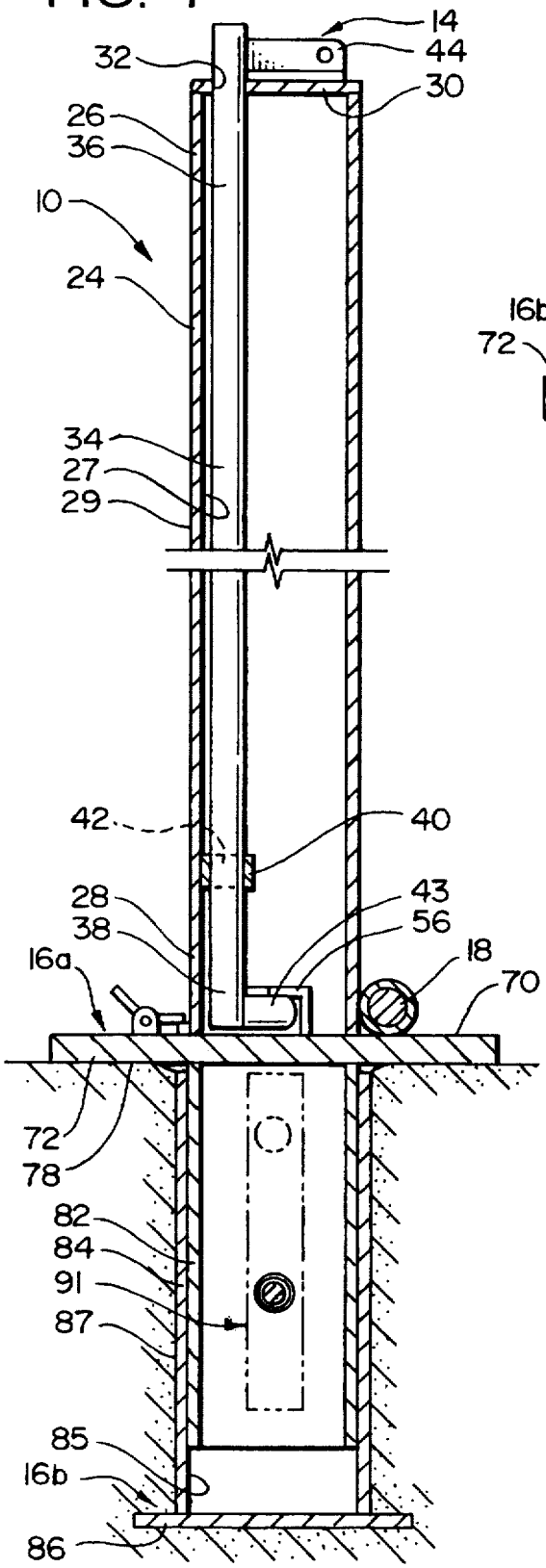
FIG. 7 is a side elevational cross-section of the barricade post assembly showing the post assembly, the security locking means, the hinge and the base assembly.

The post assembly 12 is shown in cross-section in FIG. 7, where the security locking means 14 is best illustrated. The security locking means 14 is comprised of a vertically aligned lock bar 34 positioned in the interior 27 of the tubular post section 24, the lock bar 34 having a top portion 36 and a bottom portion 38. The lid 30 defines an upper guide hole 32 to receive the top portion 36 of the lock bar 34. A guide bracket 40 defines a lower guide hole 42. The guide bracket 40 is attached, for example by welding, to the interior surface 28 of the of the tubular post section 24. The position of the guide bracket 40 on the interior surface 27 of the tubular post section 24 can be varied, but the upper guide hole 32 and the lower guide hole 42 should be coaxial. Preferably, the guide bracket 40 is located in the bottom portion 28 of the tubular post section 24 in a position that does not obstruct the engagement of the security locking means 14, as described below.

The lock bar 34 passes through the upper guide hole 32 and the lower guide hole 42. The upper guide hole 32 and the lower guide hole 42 are of slightly larger diameter than the diameter of the lock bar 34, so that the lock bar 34 can freely rotate but has little lateral movement. The lock bar 34 has a laterally extending foot 43 attached, such as by welding, to its bottom portion 38. A hasp 44 is attached, for example by welding, to the top portion 36 of the lock bar 34 to extend laterally therefrom, and positioned just above the lid 30. To position the lock bar 34 inside the tubular post section 24, the foot 43 is attached to the lock bar 34 prior to its insertion into the lower guide hole 42 and then through the upper guide hole 32. The hasp 44 is then attached, thereby securely positioning the lock bar 34 for limited rotational movement about an axis parallel to the tubular post section 24 from its top portion 26 to its bottom portion 28.

Figure 3:
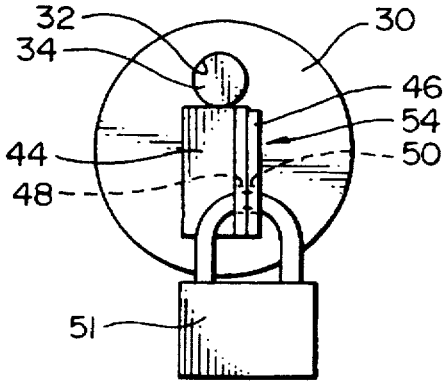
FIG. 3 is a plan view looking downwardly on the top of the barricade post assembly showing the barricade post assembly in the locked position.
Figure 4:
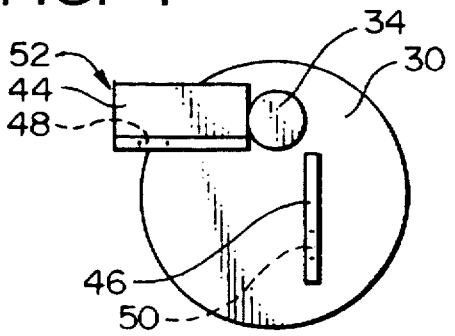
FIG. 4 is a plan view looking downwardly on the top of the barricade post assembly showing the barricade post assembly in the unlocked position.
Figure 5:
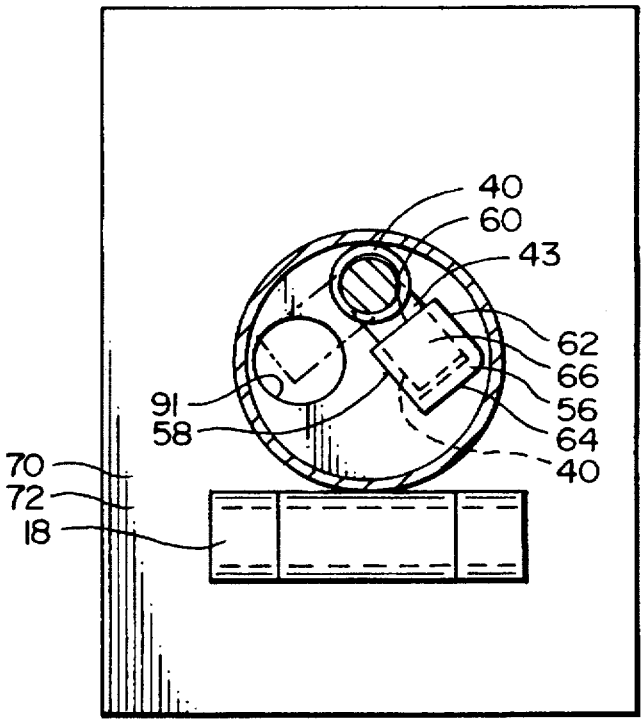
FIG. 5 is a cross-section view of the barricade post assembly taken along line 5—5 in FIG. 1 and illustrating the security locking means.

The lock bar 34 has two operational positions, which are best seen in FIGS. 3–5. In FIG. 3, the lock bar 34 is shown in a locked position, where the hasp 44 abuts a hasp stop member 46 that is attached, for example by welding, to the upper surface of the lid 30. The hasp 44 defines a first padlock hole 48 and the hasp stop member 46 defines a second padlock hole 50. When in this locked position, the first padlock hole and the second padlock hole 50 are coaxial in order to permit the insertion of an optional padlock 51. To reach the second operational position of the security lock, the lock bar 34 is rotated ninety degrees from the locked position 54 to the unlocked position 52, which is illustrated in FIG. 5. The padlock 51 has been removed and the hasp 44 and the hasp stop member 46 no longer abut.

FIG. 5 shows the effect of turning the lock bar 34 from the unlocked position 52 to the locked position 54. In the unlocked position 52, the foot 40 is unobstructed. In the locked position 54, the foot 40 is housed under a lock stop member 56. The lock stop member 56 has a first open side 58, a second open side 60, a third enclosed side 62, a fourth enclosed side 64, and a top 66. The third enclosed side 62 and the fourth enclosed side 64 are attached, for instance by welding, to an upper surface 70 of an upper base plate 72 which is part of the base assembly 16. It is important that the lock stop member 56 is attached in a position where the foot 40 engages the lock stop member 56 when in the locked position 54 and in which the lock stop member 56 does not obstruct the foot 40 when in the unlocked position 52.

Figure 6:
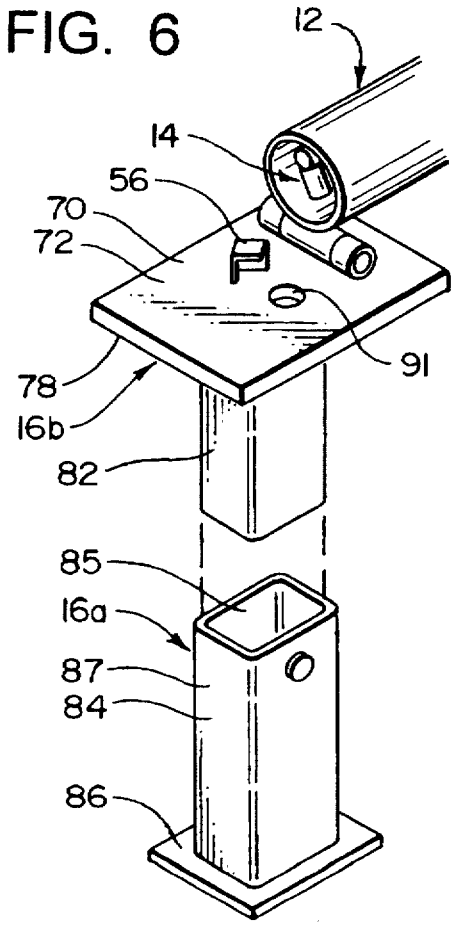
FIG. 6 is a partial elevational view illustrating the interconnection of the permanent base member and the removable base member of the base assembly.

As illustrated in FIG. 6, the base assembly 16 is comprised of a removable base member **16*b* and a permanent base member 16*a*. The removable base member 16*b* comprises the aforementioned upper base plate 72 with upper surface 70 and a lower surface 78. Attached to the lower surface 78 of the upper base plate 72 is a male tubular member 82. As discussed in the previous paragraph, the lock stop member 56 is attached to the upper surface 70 of the upper base plate 72. The upper base plate 72 also defines a latch access hole 91**.

The permanent base member **16*a* is comprised of a female tubular member 84 that is attached, for example by welding, to a lower base plate 86. The female tubular member 84 has an interior surface 85 and an exterior surface 87. In use, the permanent base member 16*a* is secured in concrete at the location that the barricade post assembly 10 is required. The lower base plate 86 provides additional resistance against removal. One or more of these permanent base members 16*a* can be permanently placed each in a different location. The remainder of the barricade post assembly 10 (i.e., the post assembly 12, the hinge 18, and the removable base member 16*b*) can be moved from location to location to mate with any of the permanent base members 16*a***, as needed.

Figure 8:
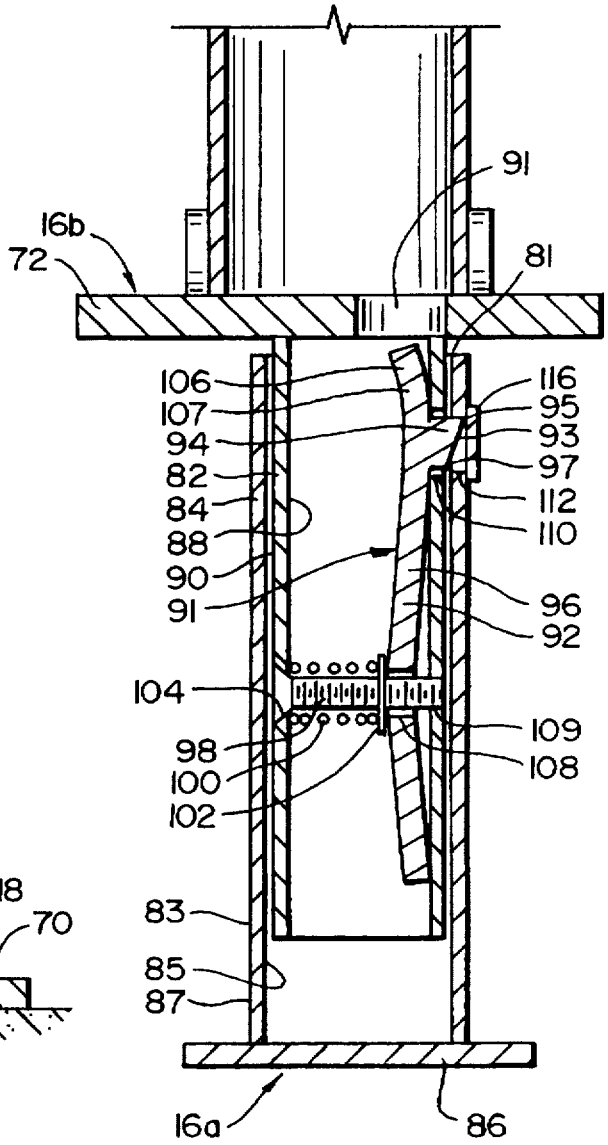
FIG. 8 is a partial side elevational cross-section of the barricade post assembly taken from a vantage point moved ninety degrees from the view of FIG. 7, and illustrating the base assembly comprised of the permanent base member, the removable base member, and the base member latch.

The base assembly 16 is shown in cross-section in FIGS. 7 and 8. The removable base member **16*b* has an interior surface 88 and an exterior surface 90. There is a latch assembly 91 releasably interconnecting the removable base member 16*b* to the permanent base member 16*a*. This latch assembly 91 comprises a latch 92 to releasably retain the removable base member 16*b* in the permanent base member 16*a* and is mounted on the interior surface 88 of the removable base member 16*b*. The latch 92 is comprised of a latch tooth 94, a latch bar 96, a mounting screw 98, a compression spring 100, and a bracket 102. The latch bar 96 is preferably made from spring steel and has a slightly bowed shape. A tab 106 is formed at an upper end 107 of the latch bar 96. The latch access hole 91 is centered directly above tab 106. The latch bar 96 is mounted to the interior surface 88 of the male tubular member 82 by inserting the mounting screw 98 through a countersunk hole 104, the spring 100, the bracket 102, through a mounting hole 108 in the latch bar 96 and then secured in a threaded hole 109. Neither end of the mounting screw 98 should extend beyond the exterior surface of the male tubular member 82**.

The latch tooth 94 is formed integrally with the latch bar 96 or can be attached by welding and projects laterally from the latch bar 96 through a first latch slot 110 formed in the male tubular member 82. A corresponding latch tooth reception slot 112 is defined in the female tubular member 84 for receipt of the latch tooth 94. The latch tooth reception slot 112 is covered by a slot cover 116 attached to an exterior side 83 of the female tubular member 84. It is preferred that the slot cover 116 be dome shaped so that the full extension of the latch tooth 94 into the latch tooth reception slot 112 is ensured.

The latch tooth 94 has a slanted contact surface 93 that slants downwardly and inwardly from it outwardly positioned top end 95 to its lower end 97. Thus, when the removable base member **16*b* is inserted into the permanent base member 16*a*, the contact surface 93 of the latch tooth 94 engages an interior edge 81 of the permanent base member 16*a* at approximately a mid-point on the slanted surface 93. As the removable base member 16*b* is further inserted into the permanent base member 16*a*, the interior edge 81 applies a force on latch tooth 94 that pushes the latch bar 96 inwardly against the resistive force of spring 100 so that the top edge 95 of the latch tooth 94 travels down the interior surface 85 of the female tubular member 84 until reaching the latch tooth reception slot 112 where the force of spring 100 pushes the latch tooth 94 into the latch tooth receptions slot 112. Once so engaged, the latch tooth 94 restricts removal of the removable base member 16*b* from the permanent base member 16*a***.

Figure 2:
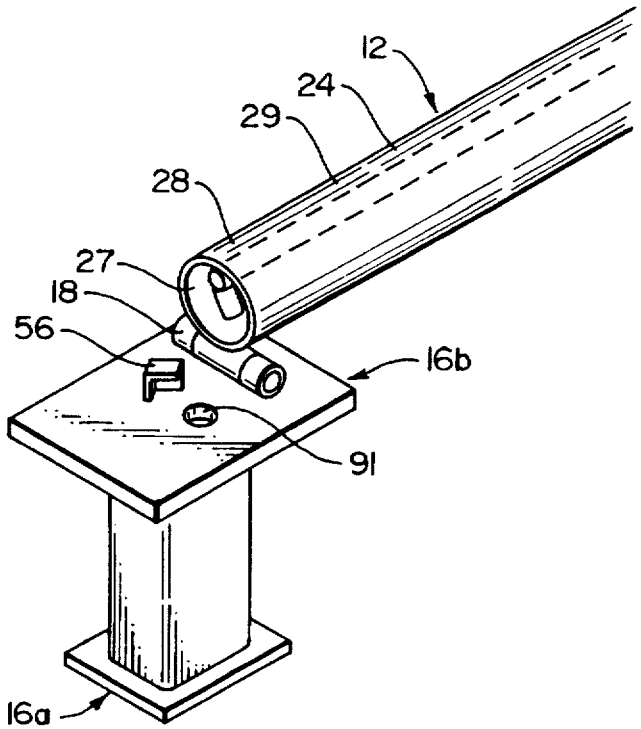
FIG. 2 is a partial side elevational view of the barricade post assembly with the post assembly in the unlocked and collapsed position.

Referring to FIG. 7, the bottom portion 28 of the post assembly 12 is connected by the aforementioned hinge 18 to the upper surface 70 of the upper base plate 72. The hinge connection 18 permits the post assembly 12 to be moved from an upright position where the post assembly 12 is perpendicular to the upper base plate 72, to a collapsed position where the post assembly 12 is approximately parallel to the upper base plate 72 and rests against the ground surface 20, as shown in FIG. 2.

Figure 11:
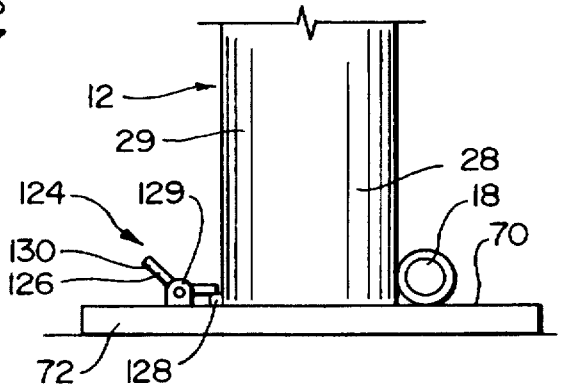
FIG. 11 is a partial side elevational view of the barricade post assembly illustrating the safety locking means with the post assembly in the upright and locked position.
Figure 12:
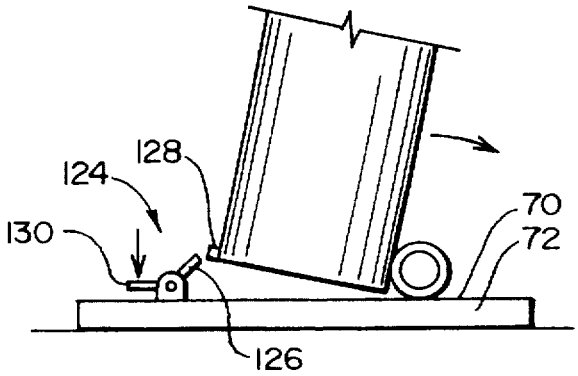
FIG. 12 is a partial side elevational view of the barricade post assembly illustrating the safety locking means with the post assembly moving toward the unlocked and collapsed position.

A safety locking means is illustrated in FIGS. 11–12. Unlike the security locking means 14, the safety locking means 124 engages the exterior surface 29 of the post assembly 12. The safety locking means 124 is preferably positioned opposite the hinge 18 located at the bottom portion 28 of the post assembly 12. The safety locking means 124 can be any of a number of configurations that are well known in the art. For instance, as illustrated in FIG. 11, the safety locking means 124 is comprised of a latch 126 and a retaining member 128. The latch 126 is attached to the upper surface 70 of the upper base plate 72 and is of a configuration commonly available and thus will not be described in detail. The retaining member 128 is attached to the post assembly 12, immediately opposite the latch 126.

The latch 126 can be disengaged from the retaining member 128 by stepping on lever 130. Assuming the security locking means 14 has been disengaged, stepping on lever 130 permits the post assembly 12 to move from its upright position, as illustrated in FIG. 11, to its collapsed position, as illustrated in FIGS. 12 and 2. In the preferred embodiment, the safety locking means 124 is used in combination with the security locking means 14. The safety locking means 124 can, therefore, be used as a "safety" if the security locking means 14 is disengaged. Of course, the safety locking means 124 can be the sole locking means when security is not an issue. For instance, if the barricade post assembly 10 is controlled by a parking lot attendant that uses the barricade post assembly 10 as a signal that the lot is not available, but requires that the barricade be easily collapsed to allow authorized users to pass, the security lock means 14 can be released, and the safety lock means 124 be used by itself Where security is not a concern, an alternative embodiment of the barricade pole assembly could omit the security lock means 14 and rely totally on the safety lock means 124 to lock and unlock the barricade pole assembly.

Let us assume that the barricade post assembly 10 is in the barricading position, as shown in FIG. 1. In this position, the removable base **16*b* is securely held in its engaged position with the permanent base member 16*a*, this being accomplished by the latch 92. As described previously herein, with the post assembly 12 in its upright position, access to the latch 92 is prevented since the access opening 91 is enclosed by the lower portion of the tubular post section 24. Also, with the padlock 51 in place, the security locking means 14 locks the post assembly 12** in its upright position.

To move the post assembly 12 to its collapsed position of FIG. 2, the padlock 51 is removed, and the hasp 44 is rotated ninety degrees to rotate the lock bar 34 ninety degrees and remove the foot 43 from its engaged position with the lock stop member 56. Then the post assembly 12 can be rotated downwardly to its horizontal collapsed position of FIG. 2. As indicated above, in the position of FIG. 2, if the barricade post assembly 10 is in a driveway, the vehicles could freely pass over the barricade post assembly 10.

Figure 9:
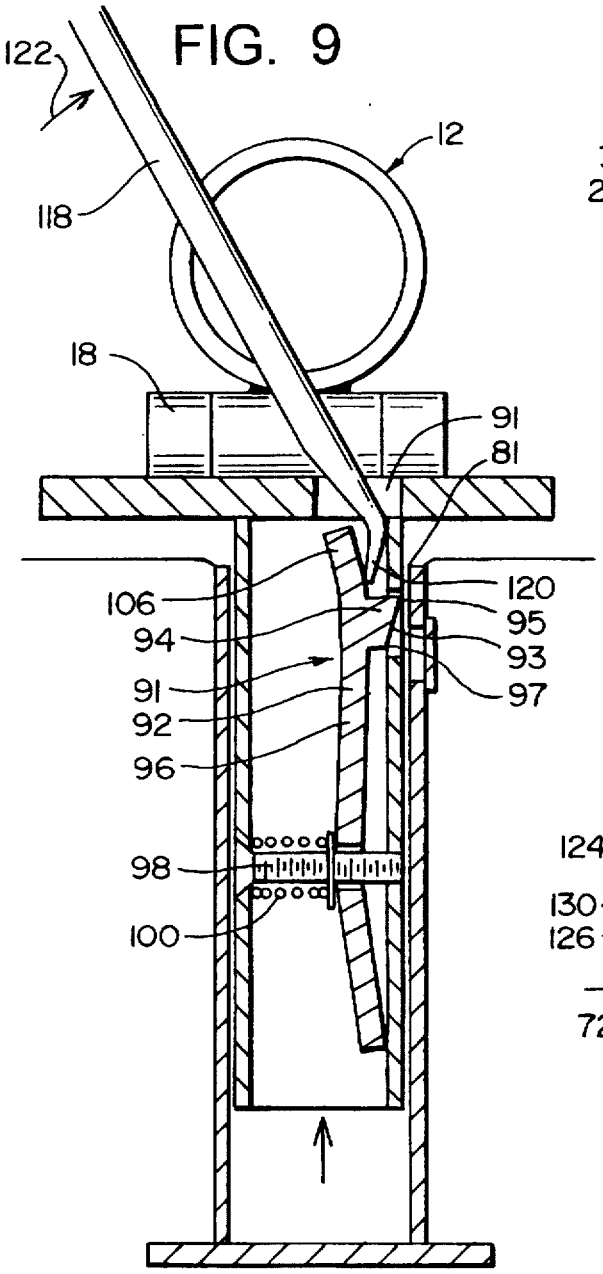
FIG. 9 is a side elevational cross-section illustrating the method for detaching the removable base member from the permanent base member while the post assembly is in the unlocked and collapsed position.

If it is desired to remove the post assembly 12 and the removable base member **16*b* from the permanent base member 16*a*, then the release operation is accomplished as shown in FIG. 9. With the post assembly 12 in the unlocked and collapsed position, the latch access hole 91 is exposed. For security purposes, it is important that the latch access hole 91 is covered by the post assembly 12 when the post assembly 12 is in its upright position. A latch disengagement tool 118 with a flat leading edge 120 is inserted into the latch access hole 91 and in front of tab 106. The latch disengagement tool 118 is then manually pivoted in the clockwise direction 122 which pushes latch bar 96 against spring 100 and disengages latch tooth 94 from latch tooth reception slot 112. While the latch tooth 94 is disengaged in this manner, the removable base member 16*b* is pulled from the permanent base member 16*a*. Since the post assembly 12 is connected to removable base member 16*b* by way of hinge 18, the post assembly 12 can conveniently be used to pull the removable base member 16*b* from the permanent base member 16*a* during this process. It should also be mentioned that any tool with a flat edge, such as a screwdriver or house key, can be used in place of the latch disengagement tool 118. If desired, a cover plate can be placed over the upper open end of the permanent base member 16*a***.

To replace the post assembly 12 back to its barricading position, essentially reverse of the above noted removal operation is accomplished. First, the post assembly 12 is rotated into its position, such as shown in FIG. 1, and the security locking means 14 is moved back into its locking position by rotating the lock bar 34 to move the foot 43 into engagement with the lock stop member 56. Then the post assembly 12 is moved over the permanent base member **16*a*, and the post assembly 12 with the removable base member 16*b* secured to one another, are lowered so that the removable base member 16*b* comes into mounting engagement with the permanent base member 16*a*. As the male tubular member 82 moves in telescoping engagement to the female tubular member 84 of the permanent base member 16*a*, the latch tooth 94 is pushed inwardly, and then when the latch tooth 94 comes into alignment with the latch tooth reception slot 112 it springs out into engagement with the permanent base member 16*a*. This secures the post assembly 12 in its upright position, and also secures the removable base member 16*b* into locking engagement with the permanent base member 16*a*. With the padlock 51 securing the hasp 44 in its locking position (see FIG. 3) the barricade post assembly cannot be removed from its barricading position, except by breaking the padlock 51** and then accomplishing the removal as described above.

Figure 10:
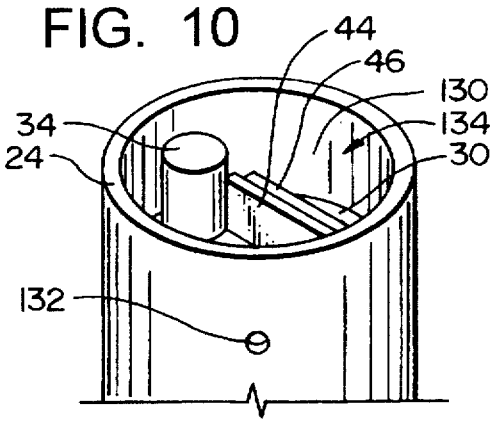
FIG. 10 is a view looking downwardly at the top of the post assembly and illustrating an alternative embodiment of the invention wherein the hasp assembly of the security locking means is recessed into the top of the post assembly for added protection against tampering.

An alternative embodiment is shown in FIG. 10. In this embodiment the security of the device is enhanced by recessing the lid 30, the lock bar 34, the hasp 44, and the hasp stop member 46 into the tubular post section 24. A drain hole 132 in the tubular post section 24 located just above the lid 3 0 drains any water that would otherwise accumulate in the recess 134.

The barricade post assembly 10 has three operating positions. In the first operating position, as shown in FIG. 1, the post assembly 12 is the upright position, the security locking means 14 is engaged, and the removable base member **16*b* is mated with the permanent base member 16*a*. FIG. 2 shows the second operating position, with the post assembly 12 in the collapsed position (lying on the ground at base location 20), the security locking means 14 is disengaged, and the removable base member 16*b* remains mated to the permanent base member 16*a*. The third operating position is shown in FIG. 6. In this position, the post assembly 12 is in the collapsed position, the security locking means 14 is disengaged, and the removable base member 16*b* has been separated from the permanent base member 16*a***.

Figure 13:
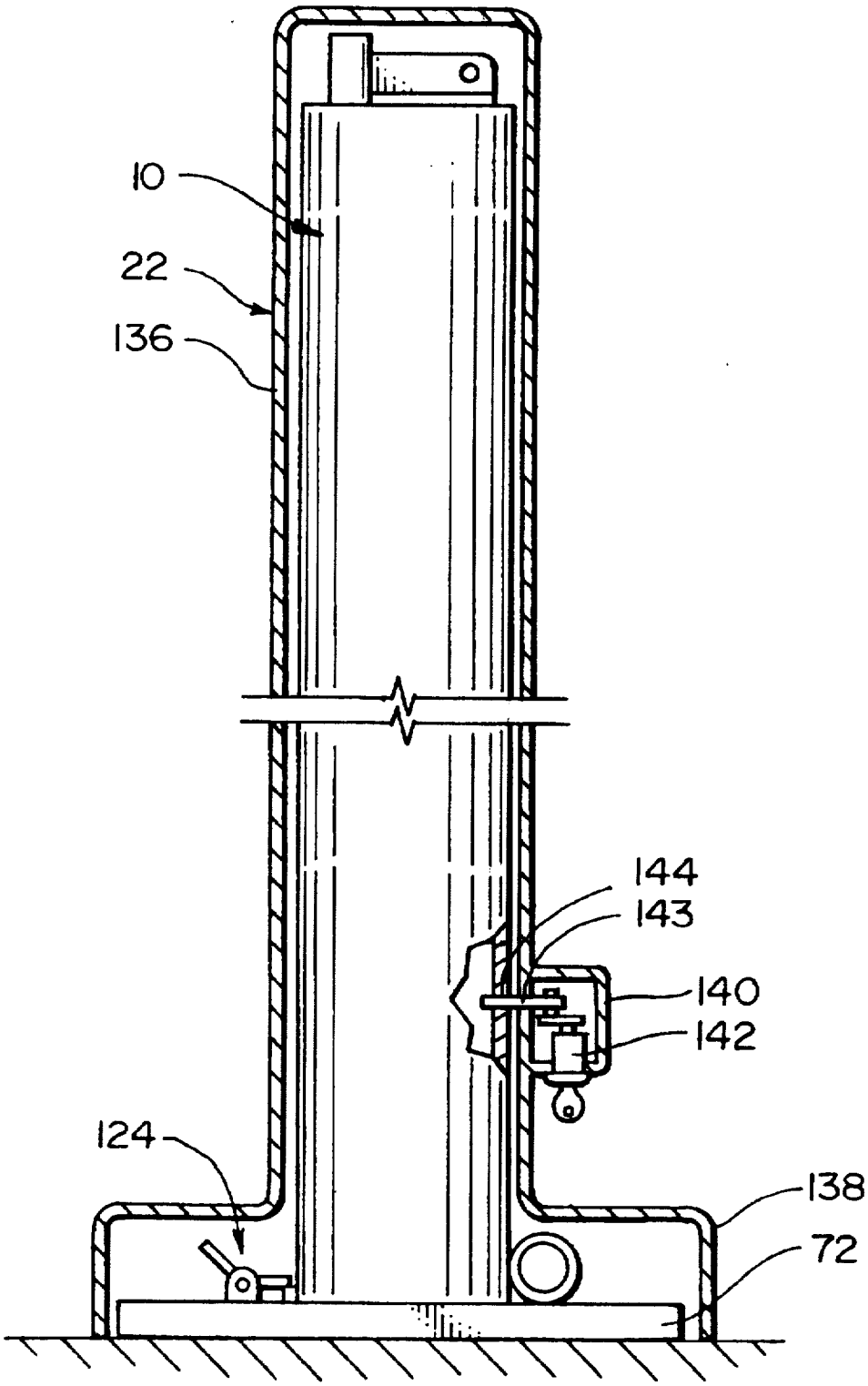
FIG. 13 is a side elevational view of the barricade post assembly with the cover assembly installed to assist in the protection of the barricade post assembly against tampering and weather. The cover assembly is shown in cross-section.

As illustrated in FIG. 13, the cover assembly 22 is comprised of a cover 136, a cover pedestal 138, a cover lock housing 140, a cover lock 142 and a cover lock slot 144. The cover assembly 22 is preferably made of steel and is dimensioned so that it fits over the entire barricade post assembly 10. A cover pedestal 138 is attached by welding, or is integrally formed with the cover 136. The cover pedestal 138 extends beyond the upper base plate 72. The cover lock 142 is contained in the protective cover lock housing 140. When the cover lock 142 is engaged, a tongue 143 rotates into the cover lock slot 144 which is formed in the tubular post section 24.

The cover assembly 22 serves the dual purpose of protecting the barricade post assembly 10 against weather and tampering. Security is enhanced by surrounding the security locking means 14 and the safety locking means 124. The cover pedestal 138 enhances security by serving to distribute the impact during attempts to topple the barricade post assembly. The cover 136 protects the barricade from snow and rain by shielding the barricade and deflecting the moisture away from it.

While this invention has been described in terms of a preferred embodiment, it is contemplated that persons reading the preceding description and studying the drawing will realize various alterations, permutations and modifications thereof It is therefore intended that the following appended claims be interpreted as including all such alterations and modifications as fall within the true spirit and scope of the present invention.

What is claimed:

1. A removable barricade post assembly adapted to be positioned at a ground location:

(a) a base assembly comprising a first permanent base member adapted to be fixedly positioned at a permanent base location, and a second removable base member constructed and arranged to interfit removably with said first base member so as to hold said second base member in fixed alignment with said fixed base member;

(b) a post section having an upper end portion, a lower end portion, an exterior surface and an interior cavity, said post section being pivotally mounted to said removable base member in a manner to be removeable between a first generally upright barricading position where the post section extends upwardly from the removable base member, and a second non-barricading position where said post section extends laterally from said moveable base member in a non-barricading position;

(c) a retaining means for releaseably securing the post section in said first upright barricading position, and being releasable to permit said post section to be moved to its second non-barricading position;

(d) said retaining means further comprises a security retaining means comprised of:

i. a lid defining a upper guide hole that is attached to the top portion of the post section and having an attached hasp stop member defining a first lock reception hole;

ii. a guide bracket defining a lower guide hole, the guide bracket being attached to the interior cavity of the post section so that the upper guide hole is coaxial with the lower guide hole;

iii. a lock bar having a hasp that defines a second lock reception hole and that is mounted on an upper end of the lock bar, a foot attached to a lower end of the lock bar, the lock bar being rotatably mounted in the upper guide hole and the lower guide hole;

iv. a lock stop member attached to an upper surface of the removable base member for reception of the foot of the lock bar when the lock bar is in the upright barricading position and that does not engage the foot of the lock bar when the lock bar is in the lowered non-barricading position;

V. the lock stop member positioned so as to be fully contained within the interior cavity of the post section when the post section is in the upright barricading position, whereby the first permanent base member can be fixedly positioned at said base location, with said second removable base member interfitting with said first base member, with said post section extending upwardly in its barricading position and retained in said first barricading position by said retaining means, said post section can be moved to a second non-barricading position with said second removable base member remaining in its engaged position with the first permanent base member, and said second removable base member can be removed from its interfitting position with said first base member so as to totally remove said post section and said second base member from the first base member and so that the security lock means secures the post section to the removable base member when in the unright barricading position and is disengaged when the post section is in the lowered non-barricading position.

2. The removable barricade post assembly recited in claim 1, wherein:

the removable base member further comprises a male tubular member having an interior chamber, and a top plate attached to the male tubular member;

a latch mounted within the interior chamber of the male tubular member for removably securing the removable base member to the permanent base member, a latch slot in the male tubular member through which a latch tooth can project, and a latch access operating means in the top plate of the removable base member for access to the latch and being fully contained within the interior cavity of the post section when the post section is in the upright barricading position;

the permanent base member further comprises a tubular female member, and a latch slot defined in the permanent base member for reception of the latch tooth;

whereby insertion of the removable base member into the permanent base member causes the latch to secure the removable base member to the permanent base member and wherein the base assembly will not separate back into the removable base member and permanent base member unless the latch is manually disengaged by accessing the latch with a latch tool through the latch access operating means.

3. The removable barricade post assembly recited in claim 1, further comprising a cover assembly that includes a cover, a cover pedestal attached to the cover, a cover lock housing attached to the cover, and a cover lock inside the cover lock housing, whereby the cover can be secured to the post assembly to provide protection against weather and tampering.

4. The removable barricade post assembly recited in claim 1, wherein the retaining means further comprises a safety retaining means, comprised of:

a retaining member attached to the bottom portion of the post section;

a latch attached to the removable base member and for engagement with the retaining member when the post section is in the upright barricading position;

latch disengagement means for disengaging the latch from the retaining member, permitting the post section to be lowered to the non-barricading position.

5. The removable barricade post assembly recited in claim 1, wherein the lid, the hasp stop member and the hasp are recessed into the post section a distance sufficient to protect the hasp and hasp stop member while still permitting access to the first lock reception hole and the second lock reception hole for engagement by a padlock.

6. The removable barricade post assembly recited in claim 1, wherein the lid, the hasp stop member and the hasp are recessed into the post section a distance sufficient to protect the hasp and hasp stop member while still permitting access to the first lock reception hole and the second lock reception hole for engagement by a padlock.

7. The removable barricade post assembly recited in claim 6, further comprising a cover assembly that includes a cover, a cover pedestal attached to the cover, a cover lock housing attached to the cover, and a cover lock inside the cover lock housing, whereby the cover can be secured to the post assembly to provide protection against weather and tampering.

8. Removable barricade post assembly adapted to be positioned at a base location:

(a) a base assembly comprising a first permanent base member adapted to be fixedly positioned at a permanent base location, and a second removable base member constructed and arranged to interfit removably with said first base member so as to hold said second removable base member in fixed alignment with said permanent base member;

(b) a post section having an upper end portion, a lower end portion, an exterior surface, said post section being pivotally mounted to said removable base member in a manner to be moveable between a first generally upright barricading position where the post section extends upwardly from the removable base member, and a second non-barricading position where said post section extends laterally from said moveable base member in a non-barricading position;

(c) a retaining means for releaseably securing the post section in said first upright barricading position, and being releasable to permit said post section to be moved to its second non-barricading position;

(d) the retaining means further comprising a safety retaining means, comprised of:

i. a retaining member attached to the bottom portion of the post section;

ii. a latch attached to the removable base member and for engagement with the retaining member when the post section is in the upright barricading position;

iii. latch disengagement means for disengaging the latch from the retaining member, permitting the post section to be lowered to the non-barricading position;

whereby the first permanent base member can be fixedly positioned at said base location, with said second removable base member interfitting with said first base member, with said post section extending upwardly in its barricading position and retained in said first barricading position by said retaining means, said post section can be moved to a second non-barricading position with said second removable base member remaining in its engaged position with the first permanent base member, and said second removable base member can be removed from its interfitting position with said first base member so as to totally remove said post section and said second removable base member from the first base member.

9. The removable barricade post assembly recited in claim 8, wherein:

the removable base member further comprises a male tubular member having an interior chamber, and a top plate attached to the male tubular member;

a latch mounted within the interior chamber of the male tubular member for removably securing the removable base member to the permanent base member, a latch slot in the male tubular member through which a latch tooth can project, and a latch access operating means in the top plate of the removable base member for access to the latch and being fully contained within the interior cavity of the post section when the post section is in the upright barricading position;

the permanent base member further comprises a tubular female member, and a latch slot defined in the permanent base member for reception of the latch tooth;

whereby insertion of the removable base member into the permanent base member causes the latch to secure the removable base member to the permanent base member and wherein the base assembly will not separate back into the removable base member and permanent base member unless the latch is manually disengaged by accessing the latch with a latch tool through the latch access operating means.

10. The removable barricade post assembly recited in claim 9, further comprising a cover assembly that includes a cover, a cover pedestal attached to the cover, a cover lock housing attached to the cover, and a cover lock inside the cover lock housing, whereby the cover can be secured to the post assembly to provide protection against weather and tampering.

11. A removable barricade post assembly adapted to be positioned at a base location, comprising:

(a) a base assembly comprising a first permanent base member adapted to be fixedly positioned at a permanent base location, and a second removable base member constructed and arranged to interfit removably with said first base member so as to hold said second removable base member in fixed alignment with said permanent base member;

(b) a post section having an upper end portion, a lower end portion, an exterior surface, said post section being pivotally mounted to said removable base member in a manner to be moveable between a first generally upright barricading position where the post section extends upwardly from the removable base member, and a second non-barricading position where said post section extends laterally from said moveable base member in a non-barricading position;

(c) a retaining means for releaseably securing the post section in said first upright barricading position, and being releasable to permit said post section to be moved to its second non-barricading position;

(d) the removable base member further comprises a male tubular member having an interior chamber, and a top plate attached to the male tubular member;

(e) a latch mounted within the interior section of the male tubular member for removably securing the removable base member to the permanent base member, and a latch slot in the male tubular member through which a latch tooth can project, and a latch access operating means in the top plate of the removable base member for access to the latch and being fully contained within the interior cavity of the post section when the post section is in the upright position;

(f) the permanent base member further comprises a tubular female member, and a latch slot defined in the permanent base member for reception of the latch tooth;

whereby the first permanent base member can be fixedly positioned at said base location, with said second removable base member interfitting with said first base member, with said post section extending upwardly in its barricading position and retained in said first barricading position by said retaining means, said post section can be moved to a second non-barricading position with said second removable base member remaining in its engaged position with the first permanent base member, and said second removable base member can be removed from its interfitting position with said first base member so as to totally remove said post section and said second removable base member from the first base member and so that insertion of the removable base member into the permanent base member causes the latch to secure the removable base member to the permanent base member and wherein the base assembly will not separate back into the removable base member and permanent base member unless the latch is manually disengaged by accessing the latch with a latch tool through the latch access operating means, whereby the security lock means secures the post section to the removable base member when in the upright barricading position and is disengaged when the post section is in the lowered non-barricading position.

12. A removable barricade post assembly, comprising:

a post assembly, comprising a post section having a top portion, a bottom portion, an interior cavity, and an exterior surface;

a base assembly, comprising a removable base member and a permanent base member, the removable base member fitting inside the permanent base member and being removable therefrom;

the removable base member further comprising a male tubular member having an interior section and an exterior section, a top plate attached to the male tubular member, a latch, and a latch access hole defined in the top plate for access to disengage the latch;

the permanent base member further comprises a tubular female member, and a latch hole defined in the permanent base member for reception of the latch;

a hinge attaching the removable base member to the post section;

a safety retaining means for securing the post section in a position normal to the removable base member when in a locked position and alternately allowing arcuate movement of the post section relative to the removable base member while in an unlocked position;

a security retaining means, comprising:

a lid having an attached hasp stop member and defining a upper guide hole, the lid being attached to the top portion of the post section;

a guide bracket defining a lower guide hole, the guide bracket being attached to the interior cavity of the post section in a manner in which the upper guide hole of the cap section is coaxial with the lower guide hole of the guide bracket;

a lock bar rotatably mounted in the upper guide hole of the cap section and the lower guide hole of the guide bracket and having a hasp on an upper end of the lock bar and a foot on a lower end the lock bar;

a lock stop member for reception of the foot of the lock bar when the lock bar is in a locked position and that does not engage the foot of the lock bar when the lock bar is in an unlocked position;

whereby the barricade post assembly obstructs vehicular traffic when in the upright barricading position, permits passage of vehicular traffic when in the unlocked and collapsed position, and may be removed to another location when in the disconnected position.

13. The removable barricade post assembly recited in claim 12, further comprising a cover assembly that includes a cover, a cover pedestal attached to the cover, a cover lock housing attached to the cover, and a cover lock inside the cover housing, whereby the cover can be secured to the post assembly to provide protection against weather and tampering.

14. The removable barricade post assembly recited in claim 12, wherein the lid, the hasp stop member and the hasp are recessed into the post section a distance sufficient to protect the hasp and hasp stop member while still permitting access to the first lock reception hole and the second lock reception hole for engagement by a lock.

15. A method for barricading a location and providing access to the location, comprising the steps of:

providing a barricade post assembly, comprising:

a post section having a top portion, a bottom portion, an interior cavity, and an exterior portion;

a base assembly, comprising a removable base member and a permanent base member, the removable base member fitting inside the permanent base member and being removable therefrom to constitute a disconnected position;

a hinge means attaching the removable base member to the post section;

a retaining means for securing the post section in a position normal to the removable base member when in an upright barricading position and alternately when unsecured allowing arcuate movement of the post section about the hinge to an unlocked and collapsed position;

installing a permanent base member at a barricading location;

engaging the removable base member with the permanent base member;

positioning the post assembly to an upright position and retaining it with retaining means in place when barricading is desired;

collapsing the post assembly to a lowered position by disengaging the retaining means and then pivoting the post assembly about the hinge when barricading is not desired;

removing the barricade post from the barricading location by disengaging the removable base member from the permanent base member the barrier post is no longer desired in that location;

said retaining means further comprises a safety retaining means, comprised of:

i. a retaining member attached to the exterior surface of the bottom portion of the post section;

ii. a latch attached to an upper surface of the removable base member and for engagement with the retaining member when the post section is in the upright barricading position;

iii. a lever attached to the latch that when depressed, disengages the latch from the retaining member;

said method further comprising:

i. engaging the safety retaining means by moving the post section into the upright barricading position until the latch automatically engages the retaining member;

ii. disengaging the safety retaining means by stepping on the lever, thereby pulling the latch away from the retaining member and then lower the post assembly to the unlocked and collapsed position to allow the passage of vehicular traffic.

16. The method of using a removable barricade post assembly as set forth in claim 15, further comprising the steps of:

providing the removable barricade post assembly wherein the retaining means further comprises a security retaining means, comprised of:

a lid defining a upper guide hole that is attached to the top portion of the post section and having an attached hasp stop member defining a first lock reception hole;

a guide bracket defining a lower guide hole, the guide bracket being attached to the interior cavity of the post section so that the upper guide hole is coaxial with the lower guide hole;

a lock bar having a hasp that defines a second lock reception hole and that is mounted on an upper end of the lock bar, a foot attached to a lower end of the lock bar, and the lock bar being rotatably mounted in the upper guide hole and the lower guide hole;

a lock stop member attached to an upper surface of the removable base member for reception of the foot of the lock bar when the lock bar is in the upright barricading position and that does not engage the foot of the lock bar when the lock bar is in the lowered non-barricading position;

the lock stop member positioned so as to be fully contained within the interior cavity of the post section when the post section is in the upright barricading position;

engaging the security retaining means by moving the post section into the upright barricading position and rotating the lock bar until the hasp abuts the hasp stop and the foot is engaged with the lock stop to obstruct vehicular traffic;

securing the security retaining means into position by placing a padlock through the first lock reception hole and second lock reception hole and then retaining the padlock;

disengaging the security retaining means by removing the padlock from the hasp and hasp stop and then rotating the hasp away from the hasp stop until the foot is no longer engaged by the lock stop and lowering the post section to the ground to allow passage of vehicular traffic.

17. The method of using a removable barricade post assembly as set forth in claim 15, further comprising the steps of:

providing the removable barricade post assembly wherein the base assembly further comprises:

a removable base member comprising a male tubular member having an interior surface, and a top plate attached to the male tubular member;

a latch mounted within the interior section of the male tubular member for removably securing the removable base member to the permanent base member, and a latch access hole for access to the latch that is defined in the top plate of the removable base member and is fully contained within the interior cavity of the post section when the post section is in the upright barricading position;

the permanent base member further comprises a tubular female member, a base plate section attached to the female tubular member, and a latch slot defined in the female tubular member for reception of the latch;

inserting the removable base member into the permanent base member until the latch secures the male tubular member to the female tubular member to install the barrier post assembly;

removing the barrier post assembly by moving the post section to the unlocked and collapsed position, inserting the latch tool through the latch access hole and prying the latch until the latch is disengaged, and then pulling the removable base member from the permanent base member.

18. The method of using a removable barricade post assembly as set forth in claim 15, further comprising the steps of:

providing a cover assembly that includes a cover, a cover pedestal attached to the cover, a cover lock housing attached to the cover, and a cover lock inside the cover lock housing;

installing the cover assembly over the removable barricade post assembly while it is in the upright barricading position;

rotating the cover lock into engagement with the post section, thereby securing the cover to the barrier post assembly.

19. The method as recited in claim 15 where said barricade post assembly is used to block vehicular traffic.

20. The method as recited in claim 15 wherein said barricade post assembly is used to protect objects from damage caused by vehicles.

21. A removable barricade post assembly adapted to be positioned at a base location in a ground strata which has an upper ground surface, said assembly comprising:

a) a base assembly comprising:

i) a first permanent base structure which is adapted to be positioned at the base location and which comprises a generally vertically aligned wall structure which extends into the ground below the ground surface and defines generally vertically aligned mounting recess;

ii) a second removable base member comprising a base mounting portion which is arranged to be positioned removably in a mounting position so as to be in mounting engagement with the wall structure and the mounting recess to maintain the second removable base member in vertical alignment with the first permanent base structure;

b) a post section having a top portion and a bottom portion mounted to the second removable base member so as to be movable between a generally upright barricading position where the post extends upwardly from the removable base member, and a second non barricading position where said post section extends laterally from said base assembly in a non-barricading position;

c) a retaining device for releasably securing the post section in the first upright barricading position, and releasable to permit said post section to be moved to its second non barricading position;

whereby the first permanent base structure can be fixedly positioned in the ground at the base location, with the second removable base member interfitting with the first permanent base structure, and with the post section extending upwardly in its barricading position and retained in the first barricading position by the retaining device, the post section can be moved to a second non barricading position with the second removable base member remaining in its engaged position with the first permanent base member, and the second removable base member can be removed from its mounting position with the first permanent base structure, so as to totally remove the post section and the second removable base member from the permanent base structure.

22. The assembly as recited in claim 21, wherein the wall structure of the first permanent base structure and the mounting portion of the second removable base member interfit with one another in a male/female interfitting relationship.

23. The assembly as recited in claim 21, wherein the base mounting portion in the mounting position is positioned within the wall structure of the first permanent base structure and in the recess of the permanent base structure.

24. The assembly as recited in claim 21, wherein there is a releasable second retaining device having a retaining position to maintain the removable base member in its mounting position and a release position to permit said removable base member to be removed from the permanent base structure.

25. The assembly as recited in claim 24, wherein said retaining device comprises a tooth member mounted to one of said permanent base structure and said removable base member with said tooth member engaging a matching opening in the other said permanent base structure and said removable base member.

26. The assembly as recited in claim 25, wherein said second retaining device comprises a retaining arm to which said tooth member is mounted, and said retaining arm is moved between the retaining position and or release position to cause the tooth member to move into and out of engagement with the opening.

27. The assembly as recited in claim 24, wherein said base assembly has a second retaining member access location in said base assembly from which said second retaining device can be operated to be moved to its unlatched release position, and said post assembly comprises access limiting structure having an access limiting position to limit access to said latch access location so as to prevent the latch means being moved to the release position when the access limiting means is in its access limiting position.

28. The assembly as recited in claim 27, wherein said access location is positioned so that with the post section in its upright position, said latch access location is inaccessible, and with the post section being moved to its second non barricading position, said access location is accessible.

29. The assembly as recited in claim 28, wherein said retaining device comprises a security locking means by which said retaining device can be locked in a retaining position to prevent movement of the post section from the barricading position to the non barricading position, so that access to said access location can be prevented.

30. The assembly as recited in claim 29, wherein there is a hinge mounting interconnecting the post section with the removable base member and said security locking device comprises a security retaining member which is engagible between said post section and said second removable base member to hold the post section in its upright position, and said security locking device comprises a locking member to maintain said security retaining member in its retaining position.

31. A removable barricade post assembly adapted to be positioned at a base location in a ground strata which has an upper ground surface, said assembly comprising:

a) a base assembly comprising a first permanent base structure adapted to be positioned at the base location in the ground strata and a second removable base member which is arranged to be positioned in a mounting position so as to be in mounting engagement with the permanent base structure;

b) a post section having a top portion and a bottom portion mounted to the second removable base member so as to be movable between a generally upright barricading position where the post extends upwardly from the removable base member, and a second non barricading position where said post section extends laterally from said base in a non barricading position;

c) a post retaining device having a retaining position to secure the post section in the first upright barricading position, and a release position to permit the post section to be moved to its second non barricading position;

d) a base retaining device having a first retaining position in which the second removable base member is retained in mounting engagement with the permanent base structure, and a release position where the removable base member can be removed from the permanent base structure;

e) said base assembly having a release access location from which the base retaining device can be moved to its release position;

f) said assembly further comprising release access limiting structure having a limiting position to exclude access to said access location when the release access limiting structure is in its limiting position.

32. The assembly as recited in claim 31, wherein said release access location is positioned so that with the post section in its upright barricading position, said release access location is not accessible, and with said post section in its non barricading position, said release access location is accessible.

33. The assembly as recited in claim 32, wherein said post retaining device comprises security locking means by which said post retaining device can be locked in its retaining position so that access to said release access location is limited.

34. A method of operating a removable barricade post assembly, said method comprising:

a) providing a first permanent base structure of a base assembly, wherein said permanent base structure comprises a generally vertically aligned wall structure, and positioning said permanent base structure in the ground so as to extend below the ground surface, with a mounting recess of said permanent base structure being vertically aligned;

b) providing a second removable base member comprising a mounting portion and positioning the mounting portion of the second removable base member into mounting engagement with the wall structure and the mounting recess of the permanent base structure so as to maintain the second removable base member in vertical alignment with the first permanent base structure;

c) further providing a post section having a top portion and a bottom portion mounted to the second removable base member so as to be movable between a generally upright barricading position where the post extends upwardly from the removable base member, and a second non-barricading position where the post section extends laterally from said base assembly in a non-barricading position;

d) operating a releasable securing device to selectively retain said post in its upright barricading position and to permit said post to be moved to its non-barricading position;

e) selectively removing said removable base member from mounting engagement with the wall structure and mounting recess of the base member to remove the removable base member and the post section from the base location.

35. The method as recited in claim 34, further comprising providing a base retaining device to selectively retain said removable base member in mounting engagement with said permanent base member, and selectively operating said base retaining device to permit removal of said removable base member from said permanent base structure.

36. The method as recited in claim 35, wherein said barricade post assembly has a base retaining access location from which said base retaining device may be accessed so as to be moved between its retaining and release positions, said method further comprising positioning said post section in its upright position and maintaining said post in its upright position by a security locking device to prevent said post section from being moved to its non-barricading position to open said base retaining access location, thus retaining said removable base member in its mounting position with the permanent base structure.

* * * * *